US005491331A

United States Patent [19]

Armentrout

[11] Patent Number: 5,491,331

[45] Date of Patent: Feb. 13, 1996

[54] SOFT X-RAY IMAGING DEVICE

[75] Inventor: Charles Armentrout, Ann Arbor, Mich.

[73] Assignee: Pilot Industries, Inc., Dexter, Mich.

[21] Appl. No.: 232,839

[22] Filed: Apr. 25, 1994

[51] Int. Cl.[6] ..... H01J 40/14

[52] U.S. Cl. ..... 250/214 VT; 250/207; 313/528

[58] Field of Search ..... 250/214 VT, 207; 313/525, 527, 528, 529, 542, 543, 103 CM

[56] References Cited

U.S. PATENT DOCUMENTS

| | | | |
|---|---|---|---|
| 3,742,230 | 6/1973 | Spears et al. . | |
| 3,743,842 | 7/1973 | Smith et al. . | |
| 3,906,237 | 9/1975 | Pittaway . | |
| 4,142,101 | 2/1979 | Yin | 250/363 R |
| 4,242,588 | 12/1980 | Silk et al. . | |
| 4,255,666 | 3/1981 | Wang et al. | 250/486 |
| 4,264,815 | 4/1981 | Reuter . | |
| 4,589,113 | 5/1986 | Hagelstein . | |
| 4,592,064 | 5/1986 | Silfvast . | |
| 4,644,574 | 2/1987 | Dahn . | |
| 4,692,934 | 9/1987 | Forsyth . | |
| 4,736,401 | 4/1988 | Donges et al. . | |
| 4,748,647 | 5/1988 | Kaiser et al. . | |
| 4,791,655 | 12/1988 | Nagata et al. . | |
| 4,840,872 | 6/1989 | Endo et al. . | |
| 4,852,133 | 7/1989 | Ikeda et al. . | |
| 4,937,832 | 6/1990 | Rocca . | |
| 4,945,551 | 7/1990 | Makabe et al. . | |
| 5,025,144 | 6/1991 | Odom et al. | 250/207 |
| 5,034,971 | 7/1991 | Suzuki . | |
| 5,045,696 | 9/1991 | Hirose . | |
| 5,047,650 | 9/1991 | Harada et al. . | |
| 5,192,861 | 3/1993 | Breskin et al. | 250/214 VT |
| 5,220,169 | 6/1993 | Ninomiya et al. . | |
| 5,239,566 | 8/1993 | Nakamura et al. . | |
| 5,338,927 | 8/1994 | de Groot et al. | 250/214 VT |
| 5,359,187 | 10/1994 | Weiss | 250/214 VT |
| 5,369,268 | 11/1994 | Van Aller et al. | 250/214 VT |

OTHER PUBLICATIONS

"ITT X-Ray Converter Configurations," ITT Corporation, Jul. 15, 1986.

"Microchannel Plates," Philips Components, Sales Brochure, Feb. 1991.

"Demountable MCP Assembly Series," Hamamatsu Corp., Technical Data Sheet, Jan. 1985.

"VUW-8990 Series," Varian Corp., Technical Data Sheet, Jun. 1979.

"The Microchannel Image Intensifier," *Michael Lampton*, pp. 62–71, *Scientific American* (Nov. 1981).

"Galileo Detector Assemblies," Galileo Electro-Optics Corporation, Data Sheet No. 7000, pp. 1–16, Mar. 1987.

*Primary Examiner*—Edward P. Westin
*Assistant Examiner*—Steven L. Nichols
*Attorney, Agent, or Firm*—Gifford, Krass, Groh, Sprinkle, Patmore, Anderson & Citkowski

[57] ABSTRACT

A soft x-ray imaging device is disclosed having a housing defining a housing chamber. An optic post having a planar surface is secured to the housing so that the planar surface is positioned within the housing chamber. A phosphorus coating is applied to the planar surface of the post for converting electrons to visible light. A microchannel plate for converting x-rays to electrons is secured within the housing chamber so that the microchannel plate is spaced from and parallel to the planar surface of the optic post. An opening is formed in the housing in alignment with the microchannel plate and this opening is sealingly closed by a window which is made of a material substantially transparent to soft x-rays. This window also creates a vacuum tight housing chamber.

15 Claims, 2 Drawing Sheets

SOFT X-RAY IMAGING DEVICE

BACKGROUND OF THE INVENTION

1. Field of the Invention

The present invention relates to an imaging device for soft x-rays.

2. Description of the Prior Art

There are many types of previously known imaging devices for use with x-rays. For example, imaging devices for hard x-rays, i.e. x-rays having an energy in excess of 30 KeV, are typically used in the medical industry. Such hard x-ray imagers are advantageous since hard x-rays pass essentially without attenuation through air and thus are convenient for medical applications. Hard x-ray imagers, however, only enjoy a resolution of about one-fifth millimeter which, while adequate for most medical applications, is inadequate for many industrial inspection applications.

The previously known imaging devices for hard x-rays, however, have not proven satisfactory as imaging devices for soft x-rays, i.e. x-rays having an energy of less than 20 KeV, for a number of reasons. First, soft x-rays rapidly attenuate in air and thus are difficult for many applications, such as medical applications, where the x-ray radiation must necessarily pass through air.

A still further disadvantage of the imaging devices for hard x-rays is that many of the imaging devices utilize a beryllium window in the imaging device. Soft x-rays, however, are readily absorbed by the beryllium window used with these prior hard x-ray imaging devices so that considerable attenuation and loss of resolution results.

There are previously known soft x-ray imaging devices and many of these previously known devices use microchannel plates for converting and multiplying x-rays to electrons. In one such imaging device the microchannel plate was supported by spaced pins and the entire x-ray imager was employed in essentially a complete vacuum. Such a mounting system for the micro channel plate is disadvantageous since the microchannel plate may distort and warp the image. Furthermore, these devices must be used in a vacuum and therefore are inappropriate for most industrial applications.

In still another type of x-ray imaging device, the microchannel plate is supported in a housing by thin disks and the housing, in turn, is sealed. These imagers, however, are easily broken and/or become misaligned when subjected to shock. Similarly, the thin disks which mount the microchannel plate to the housing fatigue and sag over time which distorts the image. Furthermore, the atmosphere within the chamber becomes cloudy over time due to outgasing from the parts inside the chamber, and diffusion through the housing which adversely affects the image.

SUMMARY OF THE PRESENT INVENTION

The present invention provides an imaging device for soft x-rays which overcomes all of the above mentioned disadvantages of the previously known devices.

In brief, the soft x-ray imaging device of the present invention comprises a housing defining a housing chamber. An optic post is constructed of a material, such as glass, which is transparent to light and the optic post is secured to the housing so that a planar surface on the optic post is positioned within the housing chamber. Means, such as a phosphorus coating, are applied to the planar surface of the optic post for converting electrons to visible light.

A microchannel plate for transforming x-rays to electrons is also secured within the housing chamber by a mounting ring extending between an annular abutment surface on the optic post and the microchannel plate. The mounting ring is tubular and cylindrical in shape and flatly abuts against both the microchannel plate and optic post in order to firmly and securely mount the microchannel plate to the optic post against movement. In doing so, the mounting ring maintains the microchannel plate spaced from and parallel to the planar surface on the optic post.

The housing also includes an opening in alignment with the microchannel plate. This opening is sealingly closed by a window made of a material, such as mylar, which is substantially transparent to soft x-rays. The window also forms a vacuum tight housing chamber in which the microchannel plate is contained.

A vacuum pump continuously evacuates the housing chamber. Thus the vacuum pump removes all gases which enter the housing chamber through diffusion or otherwise.

In operation, the housing chamber is evacuated while appropriate electric voltage potentials are applied to the opposite sides of the microchannel plate as well as the coating on the optical post planar surface. The microchannel plate then transforms and multiplies x-rays passing through the window and onto the microchannel plate to electrons. These electrons, in turn, strike the coating on the optic post and are converted to visible light. This visible light can then be viewed through the other end of the optic post.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which.

DETAILED DESCRIPTION OF PREFERRED EMBODIMENTS OF THE PRESENT INVENTION

Figure 1:
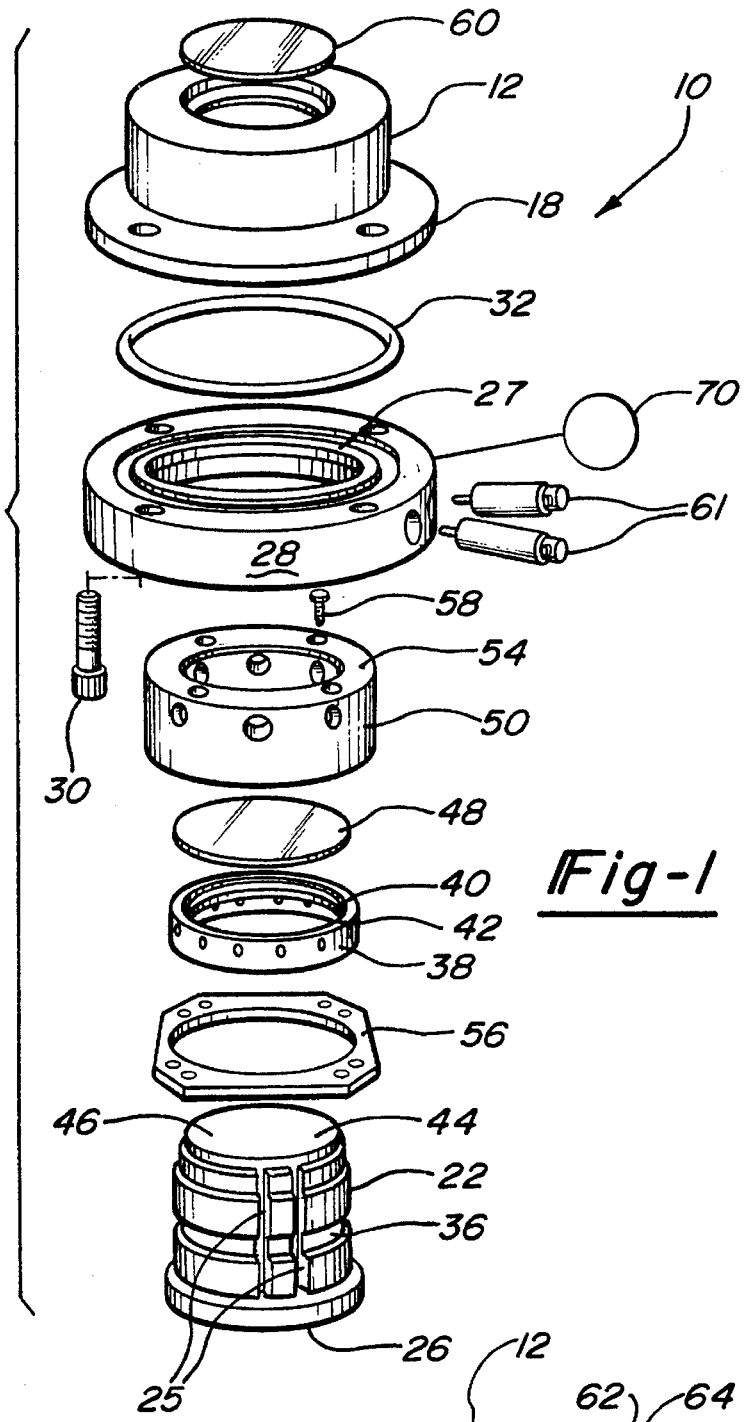
FIG. 1 is an exploded view illustrating a first preferred embodiment of the present invention.
Figure 2:
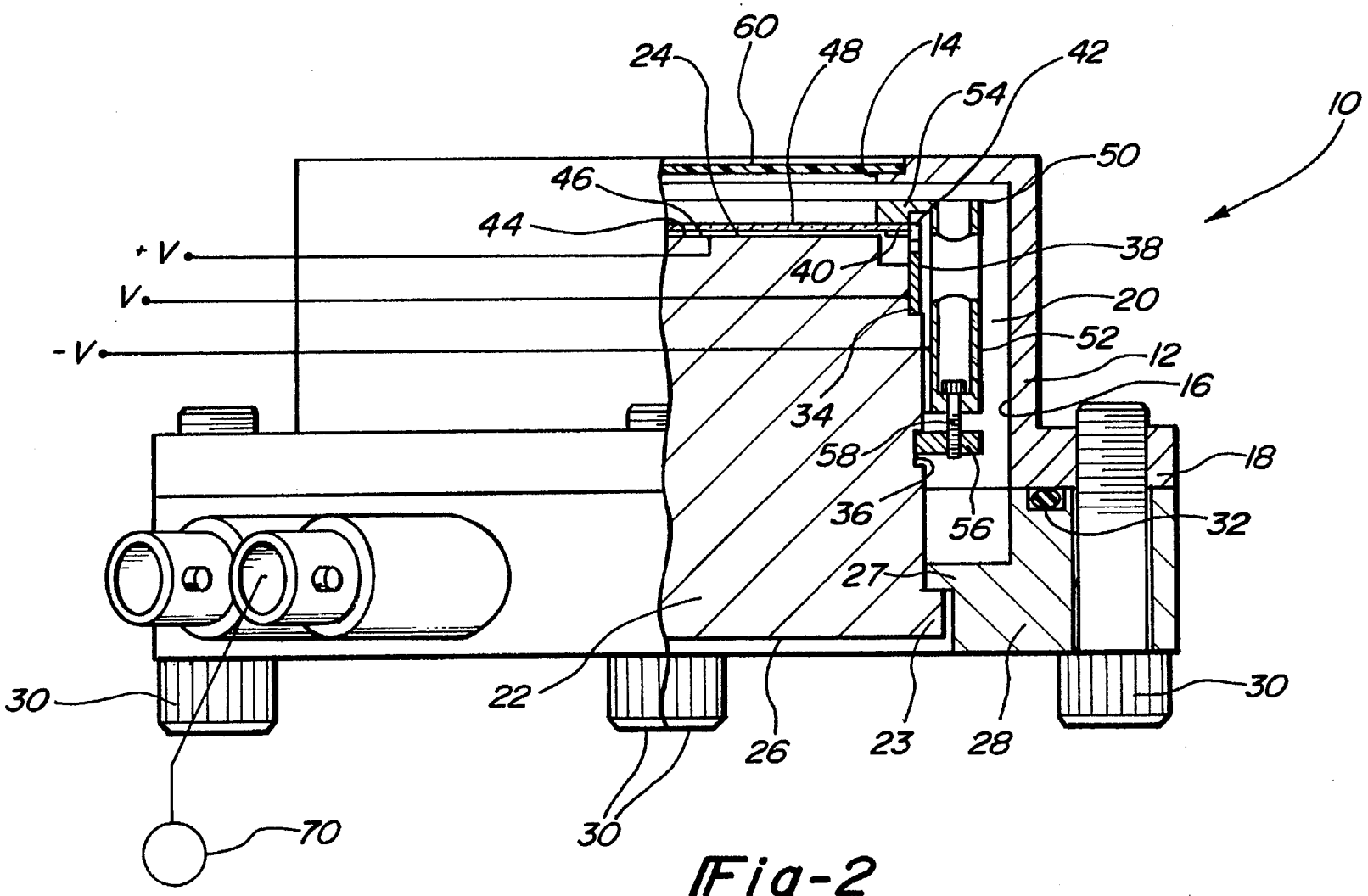
FIG. 2 is a fragmentary cross sectional view illustrating the preferred embodiment of the present invention.

With reference first to FIGS. 1 and 2, a first preferred embodiment of the soft x-ray imaging device 10 of the present invention is thereshown and comprises an annular housing 12 having an opening 14 at one end and an opening at its other end 16. An annular flange 18 extends radially outwardly from the end 16 of the housing 12. The housing 12 thus defines a housing chamber 20.

A generally cylindrical optic post 22 has a first planar end 24 and a second planar end 26 which is spaced apart and substantially parallel to the first planar end 24. The optic post is constructed of a material which is substantially transparent to visible light. Preferably, the optic post 22 is constructed of clear glass or fiber optic material.

A flange 23 on the optic post 22 is cemented to a mating flange 27 on an annular base 28 which, in turn, is secured to the flange 18 by fasteners 30. An appropriate fluid seal or O-ring 32 is provided between the flange 18 and base 28 for fluidly or vacuum sealing the housing 12 and base 28 together. Furthermore, with the optic post 22 secured to the housing 12, the planar surface 24 on the optic post 22 is positioned within the evacuated housing chamber 20 in alignment with the housing opening 14.

Still referring to FIGS. 1 and 2, the optic post 22 includes an annular abutment surface 34 which is spaced from and parallel to the optic post planar surface 24. Similarly, an annular and radially inwardly extending channel 36 is also formed in the optic post 22 at a position spaced between the annular surface 34 and the end 26 of the optic post 22.

A tubular and cylindrical mounting ring 38 has one end positioned in abutment with the abutment surface 34 and has a radially inwardly extending lip 40 formed about its other end 42. As such, one end of the mounting ring flatly and substantially continuously abuts against the abutment surface 34 on the optic post 22. The mounting ring 38, furthermore, is constructed of an electrically conductive material and forms an electrode in a fashion to be subsequently described.

The planar surface 24 is coated with a material, such as a phosphorus coating, which converts electrons to visible light. Furthermore, a conductive layer 46, such as a thin indium coating optionally doped with tin, is provided beneath the phosphorus coating 44. This conductive layer 46 also acts as an electrode in a fashion to be subsequently described.

A circular microchannel plate 48 is positioned within the housing chamber so that the outer periphery of the micro channel plate 48 flatly and continuously abuts against the lip 40 on the mounting ring 38. As such, the lip 40 maintains the microchannel plate parallel to but slightly spaced from the coating 44 on the optic post 22. Since the mounting ring 38 has an annular surface at one end which flatly and continuously abuts against one side of the microchannel plate 48 and a second annular surface at its other end which flatly and continuously abuts against the annular surface 34 on the optic post, the ring 38 effectively and accurately maintains the alignment between the microchannel plate and the surface 24 on the optic post 22 and protects the microchannel plate against warpage.

The ring 38 is constructed of a stiff metallic material and has an aspect ratio, i.e. the ratio of its diameter to its axial length, of less than fifty. Openings are formed through the ring 38 so that the vacuum in the housing chamber can be maintained on both sides of the ring 38.

In the well known fashion, the microchannel plate 48 transforms and multiplies x-rays to electrons. Similarly, each side of the micro channel plate 48 is coated with an electrically conductive material in the well known fashion.

Referring still now to FIGS. 1 and 2, in order to secure the microchannel plate 48 to the mounting ring 38, an annular clamping member 50 includes a first portion 52 which extends around a portion of the optic post 22 and an annular flange 54 which registers with the lip 40 on the mounting ring 38 but on the opposite side of the micro channel plate 48. Thus, the outer periphery of the microchannel plate 48 is sandwiched in between the flange 54 on the clamping member 50 and the lip 40 on the mounting ring 38.

An anchor ring 56 is positioned around the optic post 22 so that the anchor ring 56 is positioned within the channel 36 on the optic post 22. Threaded fasteners 58 then secure the clamping member 50 to the anchor ring 56 so that, upon tightening of the fasteners 58, the outer periphery of the microchannel plate 48 is clampingly and lockingly sandwiched in between the locking member 50 and the mounting ring 38. The clamping member 58, furthermore, is constructed of an electrically conductive material and forms an electrode as will be subsequently described.

The clamping member 58 is constructed of a metallic material and is electrically grounded. Consequently, since the clamping member surrounds the ring 38 as well as the end 24 of the optic post 22, the clamping member effectively minimizes unwanted stray electrical fields.

A window 60 is disposed across the housing opening 14 and sealed to the housing 12 in any conventional fashion. The window 60 is constructed of a material which is transparent to soft x-rays and, particularly, soft x-rays in the range of 5 KeV–15 KeV. In practice, suitable materials for the window 60 include mylar, Kapton and Kevlar. Additionally, the window 60 is preferably coated with a thin top layer, such as aluminum, in order to reflect near ultraviolet radiation. Such near ultraviolet radiation can adversely affect the resolution of the imaging device 10.

In practice, the outer electrode or clamping member 50 is electrically grounded thus grounding the side of the micro channel plate 38 closest to the window 60. A suitable high voltage, e.g. 1000 V, is then applied to the inner electrode or mounting ring 38 so that electrons freed in the micro channel plate 48 are down through the micro channel plate 48. A still higher voltage, e.g. 6000 V, is then applied to the conductive coating 46 on the optic post 22. Such voltages ensure that the electrons generated by the microchannel plate 48 and ultimately striking the layer 44 on the optic post 22 remains collimated with the axis of the optic post 22 for maximum resolution.

Preferably high voltage wires are channelled through axially extending grooves 25 formed in the optic post 22. These high voltage wires are respectively connected at one end to the inner electrode or mounting ring 38 and the conductive coating 46 on the optic post 22 and at their other end to bayonet couplings 61 (FIG. 1) on the housing 12. The bayonet couplings 61 protect the high voltage wires against breakage despite repeated connections and disconnections.

Figure 3:
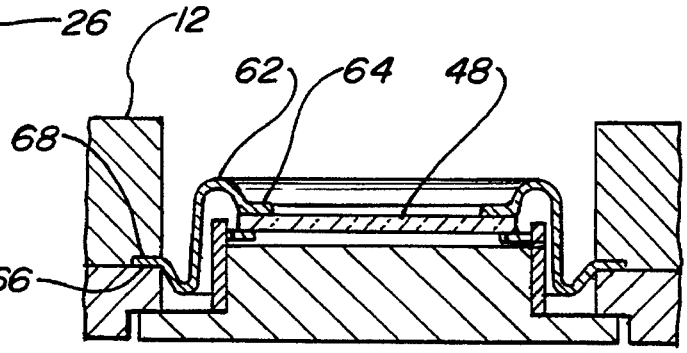
FIG. 3 is a view similar to FIG. 2 but illustrating a second preferred embodiment of the present invention.

With reference now to FIG. 3, a second embodiment of the present invention is thereshown in which a spring 62 replaces the clamping member 50 of the FIGS. 1–2 embodiment so that the spring 62 forms a clamping means. The spring 62 is annular in shape and preferably bellowed and thus has an inner periphery 64. The inner periphery 64 engages the microchannel plate 48 so that the outer periphery of the microchannel plate is sandwiched in between the inner periphery 64 of the spring 62 and the lip 40 of the mounting ring 38.

Conversely, the outer periphery 66 of the spring 62 registers with an annular abutment surface 68 formed in the housing 12. Thus, as the housing 12 is secured to the base 28 by the fasteners 30, the spring 62 compresses thus sandwiching the microchannel plate 48 against the mounting ring 38 in the desired fashion. Approximately 200 pounds of pressure is the preferred compression of the spring 62 and, like the clamping member 50, the spring 62 is formed of an electrically conductive material and forms an electrode. The central axially extending leg of the spring 62 also has an aspect ratio of less than 50.

In order to prevent electrical arcing between opposite sides of the microchannel plate 44 as well as between the microchannel plate 44 and the conductive coating 46 on the optic post 22, it is necessary that the housing chamber 20 be evacuated to a high vacuum. Consequently, a vacuum pump 70, illustrated only diagrammatically, is fluidly connected with the housing chamber 20 which continuously evacuates the housing chamber 20.

From the foregoing, it can be seen that the present invention provides a simple and yet highly effective imaging device for soft x-rays. The present invention is particularly useful for imaging soft x-rays in the range of 5–20 KEV which enables much higher resolution than hard x-ray imaging devices.

Having described my invention, however, many modifications thereto will become apparent to those skilled in the art to which it pertains without deviation from the spirit of the invention as defined by the scope of the appended claims.

I claim:

1. A soft x-ray imaging device comprising:

a housing defining a housing chamber, an optic post having a planar surface and substantially transparent to visible light and an annular mating surface surrounding said planar surface, means for securing said post to said housing so that said planar surface is positioned in said housing chamber, means on said planar surface of said post for convening electrons to visible light, means for transforming x-rays to electrons, means for mounting x-ray transforming means having a first and second side within said housing chamber so that said transforming means is spaced from and parallel to said planar surface of said optic post, said mounting means comprising a ring having two spaced annular surfaces, one annular surface on said ring substantially continuously flatly abutting and supporting an outer periphery of said first side of said x-ray transforming means, means for clamping said x-ray transforming means to said ring, said clamping means comprising an annular locking member substantially continuously flatly abutting an outer periphery of said second side of said x-ray transforming means.

2. The invention as defined in claim 1 wherein said optic post mating surface is spaced from and parallel to said optic post planar surface and wherein the other annular ring surface substantially continuously flatly abuts said mating surface.

3. The invention as defined in claim 2 wherein said transforming means comprises a microchannel plate.

4. The invention as defined in claim 1 wherein said locking member and said ring both form electrical electrodes.

5. The invention as defined in claim 1 wherein said housing includes an opening in alignment with said transforming means and comprising means substantially transparent to soft x-rays sealingly disposed across said housing opening.

6. The invention as defined in claim 5 wherein said sealing means comprises a sheet of mylar.

7. The invention as defined in claim 6 wherein said mylar sheet comprises a coating of near ultraviolet radiation reflective material on one side.

8. The invention as defined in claim 7 wherein said coating comprises a coating of aluminum.

9. The invention as defined in claim 1 wherein said converting means comprises a phosphorous coating.

10. The invention as defined in claim 1 and comprising an electrically conductive coating on said planar surface of said optic post.

11. The invention as defined in claim 1 and comprising means for evacuating said housing chamber.

12. The invention as defined in claim 1 wherein said housing includes an opening and wherein a second end of said optic post is positioned in said housing opening.

13. The invention as defined in claim 1 wherein most of the soft x-rays have an energy in the range of five–fifteen KeV.

14. The invention as defined in claim 1 wherein said means for mounting said transforming means comprises an annular spring, said spring having an inner periphery which engages an outer periphery of the transforming means and an outer periphery which engages an abutment surface on said housing.

15. A soft x-ray imaging device comprising:

a housing defining a housing chamber, said housing having an opening, a window disposed across said window, said window being constructed of a material substantially transparent to soft x-rays and said window sealingly closing said housing chamber, means for continuously evacuating said housing chamber during operation of the imaging device, an optic post having a planar surface and substantially transparent to visible light and an annular mating surface surrounding said planar surface, means for securing said post to said housing so that said planar surface is positioned in said housing chamber and in alignment with said housing opening, means on said planar surface of said post for converting electrons to visible light, means for transforming x-rays to electrons, means for mounting x-ray transforming means within said housing chamber so that said transforming means is spaced from and parallel to said planar surface of said optic post, a ring in abutment with said annular mating surface, means for clamping said x-ray transforming means to said ring, said clamping means comprising an annular member substantially continuously flatly abutting an outer periphery of a side of said x-ray transforming means.

* * * * *